US006440270B1

(12) United States Patent
Haapanen

(10) Patent No.: US 6,440,270 B1
(45) Date of Patent: Aug. 27, 2002

(54) METHOD AND APPARATUS FOR CONTROLLING DRYER SECTION OF PAPER MACHINE

(75) Inventor: Ali Haapanen, Flowery Branch, GA (US)

(73) Assignee: Metso Paper Automation Oy, Tampere (FI)

( * ) Notice: Subject to any disclaimer, the term of this patent is extended or adjusted under 35 U.S.C. 154(b) by 0 days.

(21) Appl. No.: 09/448,372

(22) Filed: Nov. 23, 1999

Related U.S. Application Data

(60) Provisional application No. 60/112,302, filed on Dec. 14, 1998.

(51) Int. Cl.[7] ..... D21F 5/00; D21F 7/00

(52) U.S. Cl. ..... 162/198; 162/252; 162/253; 162/262; 162/263; 34/524; 34/526; 34/527

(58) Field of Search ..... 162/263, 253, 162/198, 152, DIG. 10, 11; 34/524, 526, 527

(56) References Cited

U.S. PATENT DOCUMENTS 5,746,009 A 5/1998 Brugger

OTHER PUBLICATIONS

Valmet Automation, Inc. Brochure, "IQDryerTemp—The only continuous dryer surface temperature monitoring system" (not published prior to Dec. 14, 1998).

"US mill uses space–age technology to monitor drying sectioin", *Paper Technology*, Jun. 1998, p. 17.

*Primary Examiner*—Peter Chin

(74) *Attorney, Agent, or Firm*—Alston & Bird LLP

(57) ABSTRACT

In controlling the dryer section of a paper machine, the basis weight and moisture of the paper web, the energy fed into the drying cylinders of the dryer section and the machine speed are measured, and then the surface temperature of the drying cylinders is predicted on the basis of the measured values. At the same time, the actual surface temperature of the dryer cylinders is also measured, and if the measured value deviates from the predicted value, any defects in the drying apparatus can be detected quickly. In another aspect, a determination is made of the normal correlation between the power consumption of the drive motors of the cylinders in the drying apparatus and the machine speed. These variables are also measured, and if the correlation of the variables is deviant, it can be concluded that there is a failure in the drying apparatus. In that case it is possible to identify the dryer cylinder where the failure is by measuring the temperature of the cylinders. This can be determined on the basis of the fact that the dryer cylinder which for example cools down faster than the others is the cylinder where the failure is.

3 Claims, 3 Drawing Sheets

METHOD AND APPARATUS FOR CONTROLLING DRYER SECTION OF PAPER MACHINE

CROSS-REFERENCE TO RELATED APPLICATIONS

This application is related to U.S. provisional Patent Application No. 60/112,302 filed Dec. 14, 1998 and claims priority thereof

FIELD OF THE INVENTION

The invention relates to a method for controlling the dryer section of a paper machine. The invention also relates to an apparatus for controlling the dryer section of a paper machine.

BACKGROUND OF THE INVENTION

The prior art includes systems in which the temperature of drying cylinders is determined and problems in the dryer section are detected on the basis of the temperature. For example, U.S. Pat. No. 5,746,009 discloses a process and apparatus for controlling the surface temperature of a drying cylinder of a paper machine. The cylinder surface temperature is determined and controlled by using measurements of air-steam and condensate mixture temperatures emerged from the drying cylinder. Thus, the measurements do not give the actual temperature of the cylinder surface, but the temperature of the media inside the cylinder. These temperatures are not equal. Consequently, this method does not give true and accurate values for drying cylinder control.

The object of the present invention is to provide a method and apparatus by means of which a dryer section can be monitored and controlled accurately and reliably.

SUMMARY OF THE INVENTION

The basic idea of the invention is that the basis weight and moisture of a paper web, the energy fed into the cylinders of the drying apparatus and the machine speed are measured, and then the surface temperature of the drying cylinders of a paper machine is predicted on the basis of the measured values. At the same time, the actual surface temperature of the cylinders is also measured, and if the measured value deviates from the predicted value, any defects in the drying apparatus can be detected quickly. Another idea of the invention is to determine the normal correlation between the power consumption of the drive motors of the cylinders in the drying apparatus and the machine speed and to measure these variables. If the correlation of the variables is deviant, it can be concluded that there is a failure in the drying apparatus. In that case it is possible to identify the dryer cylinder where the failure is by measuring the temperature of the cylinders. This can be determined on the basis of the fact that the dryer cylinder which for example cools down faster than the others is the cylinder where the failure is.

An advantage of the invention is that the control and maintenance of the dryer section can be improved and the quality and production enhanced since the problems occurring in the drying apparatus can be identified quickly and accurately. Further advantages include improved temperature control in ramp up sections, faster grade changes, fewer breaks and faster recovery from sheet breaks. Furthermore, thanks to the better monitoring of the dryer section and real-time information, curl cockle, mettle and shrinkage can be reduced, and printing surface as well as other properties of paper can be improved.

Thus, in accordance with one aspect of the present invention, a method for controlling the dryer section of a paper machine is provided, the method comprising measuring the basis weight and the moisture of a fiber web, the drying capacity factor of the dryer section and the machine speed, determining the surface temperature of a drying cylinder of the dryer section on the basis of these measurements, measuring the surface temperature of the drying cylinder of the dryer section and comparing the determined value with the measured value and determining on the basis of deviation between the values whether the dryer section functions correctly.

The apparatus of the invention comprises means for measuring the basis weight and moisture of a fiber web, means for measuring the machine speed, a control unit for determining the surface temperature of a drying cylinder on the basis of these measurements and means for measuring the surface temperature of the drying cylinder, the control unit being arranged to compare the determined value with the measured value and determine on the basis of deviation between the values whether the dryer section functions correctly.

In this application, the term "paper" also refers to paper board, tissue and sheet of pulp.

BRIEF DESCRIPTION OF THE DRAWINGS

Some of the features of the invention having been stated, others will become apparent from the detailed description which follows, and from the accompanying drawings, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
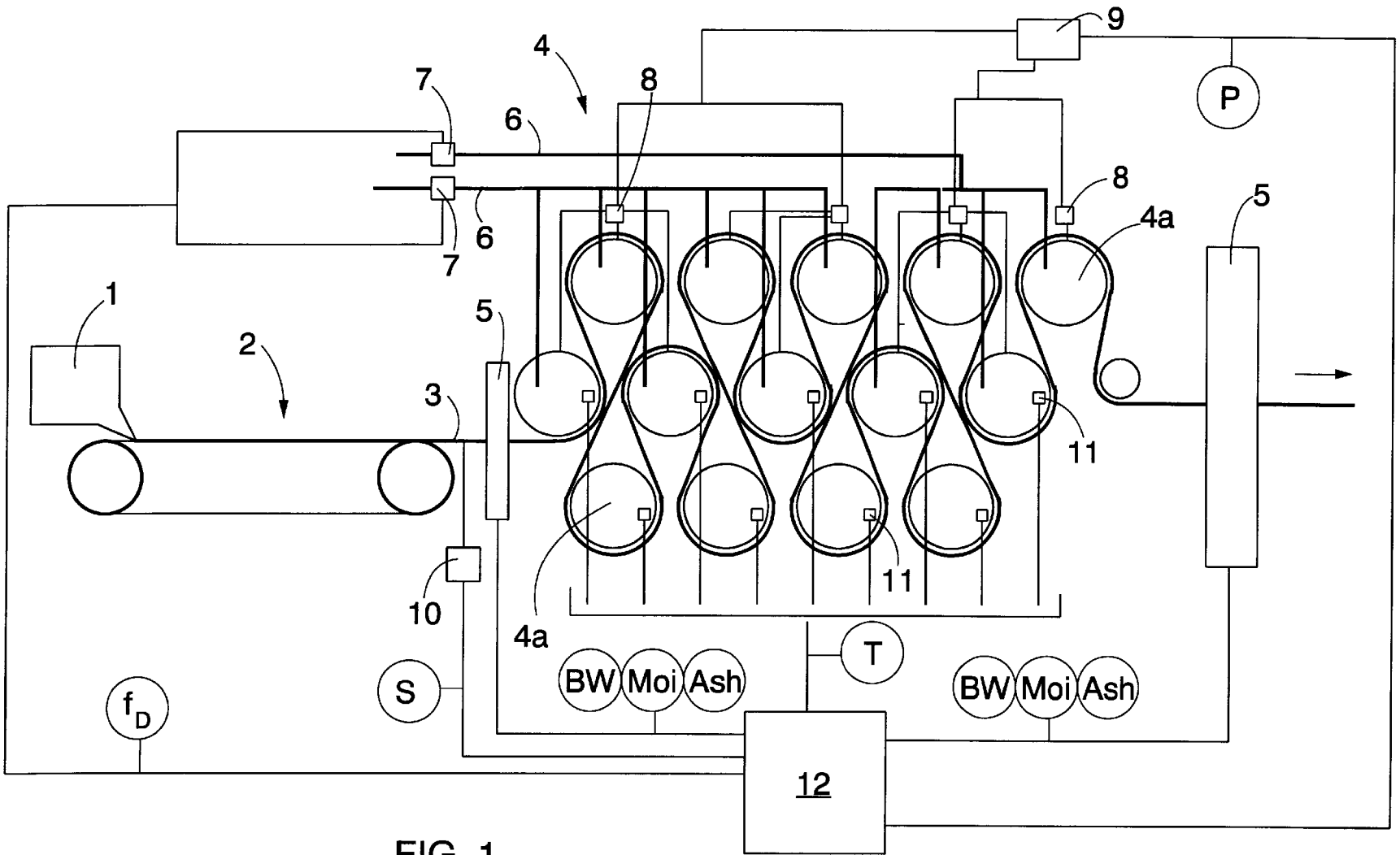
FIG. 1 is a schematic illustration of a paper manufacturing process in accordance with the invention.

FIG. 1 schematically illustrates the paper manufacturing process. The paper machine comprises a headbox 1, from which pulp or fiber furnish is fed into a former 2, where a fiber web 3 is formed of the pulp. After the former 2, the fiber web 3 is dried in a dryer section 4. A measuring scanner 5 is arranged after the dryer section 4 and optionally also before the dryer section. The paper machine also includes a take-up reel, and may include other conventional elements such as presses, size presses or calenders, which are not illustrated in the accompanying figure for the sake of clarity. Furthermore, the function of the paper machine is known per se to a person skilled in the art, and thus it will not be explained more closely in this context.

The dryer section 4 may comprise several dryer cylinders 4*a*. In addition, if the dryer section 4 consists of a yankee cylinder, for example, the yankee cylinder may be the only drying cylinder 4*a* in the dryer section 4. The dryer section 4 may be divided into different smaller groups, in fact, the dryer section 4 may comprise a front dryer section, main dryer section and after dryer section. Every one of these smaller sections and thereby the entire dryer section 4 has been divided into drying groups, where there are dryer cylinders 4*a* in different groups. The number of dryer cylinders 4*a* in each drying group is determined by different factors. For example, in each group, the drying capacity needed and the length of the entire dryer section 4 are defining the number of the dryer cylinders 4*a*. Steam is fed into each drying group through steam pipes 6, which steam is then supplied to dryer cylinders 4*a*. For the sake of clarity, the accompanying figure illustrates only some of the steam pipes 6. There are measuring means 7 connected to the steam pipes 6 which can be used for measuring the steam flow, steam pressure and steam temperature, and the amount of input and output energy of the cylinders 4*a* can be determined from this measurement. Thus, the drying capacity factor $f_D$ of the dryer section can be determined from one or more measurements. The drying capacity factor $f_D$ of each cylinder group can be measured separately, if desired.

The power P consumed by the drive motors 8 of the dryer cylinders 4*a* can be measured by a measuring device 9. For the sake of clarity, the figure illustrates only some of the drive motors 8. For measuring the power P, the current and operating speed of the drive motor 8, for example, can be measured. The power P can be measured for each drive motor separately or for all drive motors of the whole cylinder group.

A speed measuring device 10 is used for measuring the machine speed S. The machine speed S may be measured for example from the former 2 or from another section of the paper machine or from several sections of the paper machine. The measuring scanner 5 is used for measuring, for example, the basis weight BW, moisture Moi and the ash content Ash of the fiber web 3.

A temperature sensor 11 is arranged at one or more points of the dryer cylinders 4*a*, e.g. at their both ends, for measuring the surface temperature T of the dryer cylinders 4*a*. For the sake of clarity, only some of the temperature sensors 11 are shown in the accompanying figure. The temperature sensor 11 may be a temperature sensor sold by Health Technologies, Inc., St. Petersburg, Fla. USA under the trade name CorTemp, which is a wireless temperature sensor which is fastened directly to the dryer cylinder and transmits temperature information to a receiving device which converts the sensor signals into digital information. Alternatively, the system can employ other known types of temperature sensors suitable for measuring on-line, continuously the temperature or the surface temperature of the dryer cylinder 4*a*.

Measuring results from all measuring devices and sensors are supplied to a control unit 12. By using fuzzy logic or another similar method, the control unit 12 utilizes a model of the papermaking process to determine and predict the temperature T of each dryer cylinder 4*a* on the basis of the drying capacity factor $f_D$ of the dryer section 4, the basis weight BW and moisture Moi of the fiber web 3 and the machine speed S. By comparing the measured temperature T with the predicted temperature it can be concluded whether there are defects or failures in a dryer cylinder 4*a* of the dryer section 4. In particular, those dryer cylinders 4*a* whose surface temperature 4*a* decreases without any apparent reason are to be identified. The reason for this is typically a failure in the dryer cylinder 4*a* itself For example, reduced condensate removal causes condensate to build up in the dryer cylinder 4*a*, which in turn causes the surface temperature of the dryer cylinder 4*a* to decrease, and as a result, the drying capacity decreases. At worst, condensate build-up may lead to machine shutdown.

The model of the paper making process addresses the various factors that influence the operation of the dryer cylinder. Decrease of the basis weight of the fiber web 3 without any other changes increases the surface temperatures of the dryer cylinders 4*a*. Increase of the moisture of the fiber web 3 without any other changes decreases the surface temperature of the dryer cylinders 4*a*. Increase of the steam pressure, flow or temperature or increase of another drying capacity factor $f_D$ of the dryer section increases he surface temperature of the dryer cylinder 4*a*. Increase of the machine speed S without any other changes decreases the surface temperature of the dryer cylinders 4*a*. Thus, these changes in the starting values have different kinds of effect on the surface temperatures of the dryer cylinders 4*a*. What makes this even more complex is the fact that the changes may occur simultaneously. Thus, the effect of each starting value and its change on the surface temperature of the dryer cylinder 4*a* should be measured, determined and modeled separately. In addition, it should be measured, determined and modeled how these factors together influence the surface temperature T of the dryer cylinder 4*a*. In that case, the control unit 12 can be used for determining and predicting what the surface temperature T of the dryer cylinder 4*a* should be at a given moment. Thus, any failures can be detected quickly and accurately on the basis of the measuring result.

The surface temperatures T of different dryer cylinders 4*a* that have been measured at the same time are compared with one another. The surface temperatures T of the dryer cylinders 4*a* that are in the same drying group should not substantially differ from one another in the normal situation. If, however, a deviation is detected in the surface temperature T of a dryer cylinder 4*a*, a failure which is probably in the dryer cylinder 4*a* in question can be located quickly. A temperature history is also collected from the measured data; and thus, the measured data can be compared with the temperature data measured in a similar situation. It can be concluded from the degree of deviation of the temperatures whether the dryer cylinder in question functions in the same way as in an earlier situation or whether a failure has occurred.

Data on the power P used by the drive motors 8 or by a drive motor group are also supplied to the control unit 12. The power P consumption and machine speed S have a certain correlation, which can be determined in the normal situation when the paper machine is in use. If the ratio between the power P consumption and the machine speed S deviates from the normal correlation, it can be noticed that the dryer section 4 has experienced a failure. For example, increase of the power consumption of the drive motor 8 or the drive motor group without increase of the machine speed S is a good indication of the fact that condensate is building up in one or more dryer cylinders 4*a* or in a drying cylinder group; in other words, the weight of the dryer cylinder 4*a* increases. The dryer cylinder 4*a* that has caused the failure can be identified by monitoring the surface temperatures of the dryer cylinders 4*a*. In that case, the drying cylinder which cools down, or if all drying cylinders cool down, then the drying cylinder which cools down quicker than the others is most probably the one where the problem is. Furthermore, the power P consumption may be considered one factor when the surface temperatures T of the dryer cylinders 4*a* are determined by calculation.

Figure 2:
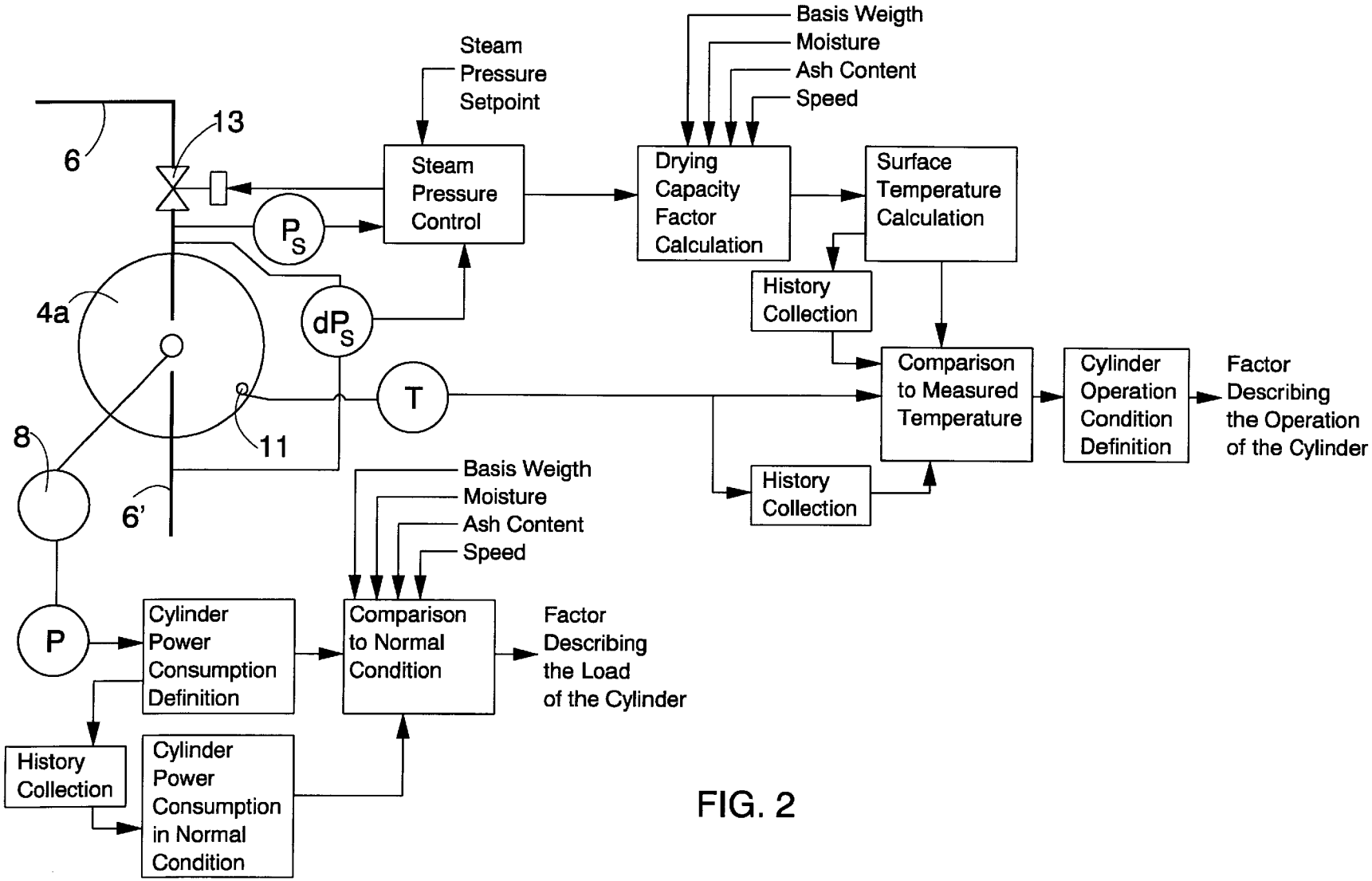
FIG. 2 is a block diagram describing the models used in the invention.

The models needed to implement the invention can be formed by applying the teachings of FIG. 2 and the following publications, for example: *Dynamic Modelling and Simulation of Multi-Cylinder Paper Dryers*, Håkan Persson, Department of Chemical Engineering I, Lund University, May 1998 and *An Experimental and Theoretical Study of Multi-Cylinder Paper Drying*, Björn Wilhelmsson, Department of Chemical Engineering I, Lund University, February 1995.

FIG. 2 schematically shows a dryer cylinder 4*a*. Steam is fed into the dryer cylinder 4*a* through a steam pipe 6 and the steam exits from the dryer cylinder 4*a* through a steam exit pipe 6'. The steam pressure $P_s$ and the difference of the steam pressures in the steam pipe 6 and the steam exit pipe 6' $dP_s$ are measured and the measurement results are led to steam pressure control. The steam pressure setpoint is also fed to steam pressure control and the steam pressure control controls the steam pressure by adjusting a control valve 13. Steam pressure control also feeds its information to drying capacity factor calculation. Also the measured basis weight, moisture and ash content of the paper web and the machine's speed are fed to drying capacity factor calculation. By using all the measured information, the surface temperature of the dryer cylinder 4*a* is calculated. The surface temperature T of the dryer cylinder 4*a* is also measured with the temperature sensor 11. The calculated temperature is compared to the measured temperature and thereby the cylinder operation condition is defined. The factor describing the operation or a change in the operation of the cylinder is composed. The factor is either calculated or determine by means of logical inference. The factor tells whether there is a failure in the dryer cylinder 4*a* or whether it is operating correctly. If there is a failure, it can be detected and thereafter repaired quickly.

History may be collected from the calculated temperature and also from measured temperature, and the collected history may be used when comparing the calculated temperature to the measured temperature. It is possible to form history trends from the collected history to determine how the paper machine will behave in certain conditions. When the paper machine is later used in the same conditions, it is easy to compare whether the paper machine functions in the same way as indicated by the history trend, i.e. whether the paper machine functions correctly.

Figure 3:
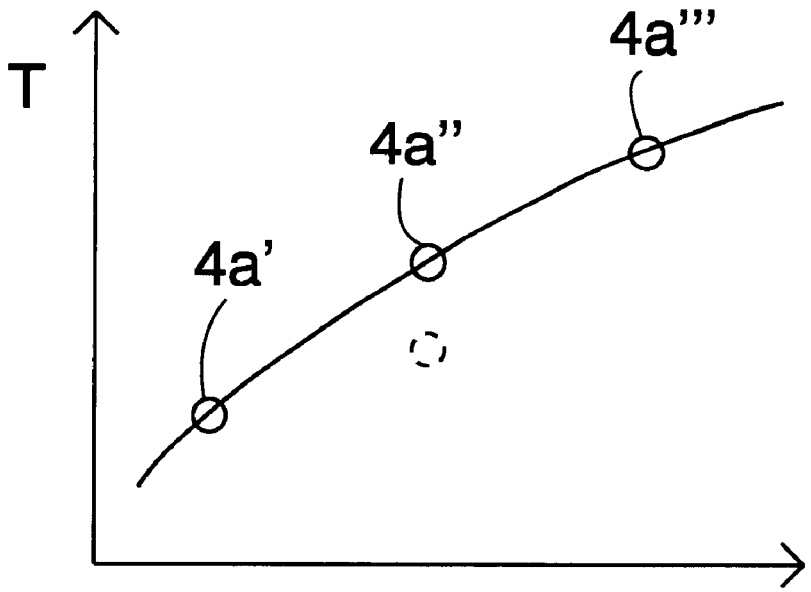
FIG. 3. schematically illustrates development of the paper web temperature in the paper machine.

In FIG. 3, curve 14 illustrates development of the paper web temperature. In FIG. 3, the vertical axis represents the temperature and the horizontal axis the location of the dryer cylinders. FIG. 3 shows the surface temperature of three successive dryer cylinders 4*a*', 4*a*", 4'" in a normal situation, i.e. in the case of successive cylinders the surface temperature of the following cylinder is typically higher than that of the preceding cylinder. In a normal situation the surface temperatures of cylinders follow the curve 14 determined on the basis of the history information. In FIG. 3, the broken line illustrates an exceptional situation, i.e. the temperature of the middle cylinder is not on the supposed temperature curve 14. In that case it can be defined simply and rapidly that the cylinder 4" in question is faulty.

The power P used by the drive motor 8 is measured and thereby the cylinder power consumption is defined. History is collected from the measurements and cylinder power consumption at normal condition is determined. The normal power consumption depends on the basis weight, moisture and ash content of the fiber web and the machine speed which are measured and thereby the power consumption at normal condition is calculated. The measured cylinder power consumption is compared to the calculated normal condition power consumption and a factor describing the load of the cylinder or a change in the load of the cylinder is composed. The measurement of the power consumption of the drive motors 8 describe the magnitude of the water load in the cylinder. At normal conditions there is a water film inside the dryer cylinder but in case of a failure the water film becomes thicker, thereby causing water load in the cylinder.

The figures and the related description are only intended to illustrate the inventive concept. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for controlling the dryer section of a paper machine, the method comprising;

measuring the basis weight and moisture of a fiber web, the drying capacity factor of the dryer section and the machine speed;

modeling the drying process and determining a predicted surface temperature of the dryer cylinder of the dryer section on the basis of these measurements;

measuring the surface temperature of the dryer cylinder; and comparing the determined predicted value with the measured value, and determining on the basis of deviation between the values whether the dryer section functions correctly.

2. An apparatus for controlling the dryer section of a paper machine, the apparatus comprising means for measuring the basis weight and moisture of a fiber web, means for measuring the drying capacity factor of tile dryer section, means for measuring the machine speed, a control unit for modeling the drying process and determining a predicted surface temperature of a drying cylinder of the dryer section on the basis of these measurements, and means for measuring the surface temperature of the dryer cylinder of the dryer section, the control unit being arranged to compare the determined predicted value with the measured value and determine on the basis of deviation between the values whether the dryer section functions correctly.

3. A method for controlling the dryer section of a paper machine, the method comprising:

measuring either a) the basis weight and moisture of a fiber web, the drying capacity factor of the dryer section, and the machine speed; or b) tie power consumed by the drive motors of the dryer cylinders in the dryer section and the machine speed;

modeling the drying process and determining a predicted surface temperature of the dryer cylinder of the dryer section on the basis of either measurement a) or measurement b);

measuring the surface temperature of the dryer cylinder; and comparing the determined value with the measured value, and determining on the basis of deviation between die values whether the dryer section functions correctly.

* * * * *

UNITED STATES PATENT AND TRADEMARK OFFICE

CERTIFICATE OF CORRECTION

PATENT NO. : 6,440,270 B1
DATED : August 27, 2002
INVENTOR(S) : Haapanen

It is certified that error appears in the above-identified patent and that said Letters Patent is hereby corrected as shown below:

Title page,
Item [56], References Cited, OTHER PUBLICATIONS,
"sectioin" should read --section--.

Column 6,
Line 22, after "comprising" the semicolon (;) should be a colon -- (:) --;
Line 39, "tile" should read -- the --;
Line 55, "tie" should read -- the --;
Line 64, "die" should read -- the --.

Signed and Sealed this

Twenty-first Day of January, 2003

JAMES E. ROGAN
*Director of the United States Patent and Trademark Office*